US009266697B2

(12) United States Patent
Houston et al.

(10) Patent No.: US 9,266,697 B2
(45) Date of Patent: Feb. 23, 2016

(54) COMMUNICATIONS CABLE PAYOUT BAGS

(75) Inventors: Eddy Robert Houston, Claremont, NC (US); David Lewis Wilson, Stony Point, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 1764 days.

(21) Appl. No.: 12/484,393

(22) Filed: Jun. 15, 2009

(65) Prior Publication Data

US 2010/0314484 A1 Dec. 16, 2010

(51) Int. Cl.

| | |
|---|---|
| ***B65H 49/32*** | (2006.01) |
| ***A45C 3/00*** | (2006.01) |
| ***A45C 13/02*** | (2006.01) |
| ***A45C 11/00*** | (2006.01) |

(52) U.S. Cl.

CPC ..... *B65H 49/322* (2013.01); *A45C 3/00* (2013.01); *A45C 3/001* (2013.01); *A45C 13/02* (2013.01); *A45C 11/00* (2013.01); *A45C 2013/026* (2013.01)

(58) Field of Classification Search

USPC ..... 242/170, 171, 588, 588.3, 588.6, 129, 242/588.4, 588.5, 579–580, 125–125.3; 224/580, 610, 237, 162; 206/397, 408, 206/409, 389, 303, 702, 3; 182/70, 73; 441/80, 81, 84, 26; 150/130, 120, 110

See application file for complete search history.

(56) References Cited

U.S. PATENT DOCUMENTS

| | | | | |
|---|---|---|---|---|
| 1,090,612 | A * | 3/1914 | Goldsmith | 242/588.6 |
| 2,400,417 | A * | 5/1946 | Hickey | 242/137.1 |
| D196,953 | S | 11/1963 | Jepson et al. | |
| 3,150,769 | A | 9/1964 | Cohn | |
| 3,412,847 | A | 11/1968 | Wise et al. | |
| 3,815,843 | A * | 6/1974 | Fortune | 242/588.1 |
| D248,891 | S | 8/1978 | Pfleger | |
| 4,160,533 | A * | 7/1979 | Kotzur et al. | 242/137.1 |
| D284,333 | S | 6/1986 | Huston | |
| 4,650,073 | A | 3/1987 | Young | |
| 4,771,889 | A | 9/1988 | Bauer et al. | |
| 5,139,210 | A | 8/1992 | Schaffer | |
| D333,039 | S | 2/1993 | Wells et al. | |
| D340,387 | S | 10/1993 | Melk | |
| D340,621 | S | 10/1993 | Melk | |
| D340,840 | S | 11/1993 | Melk | |
| D414,082 | S | 9/1999 | Keene | |
| 6,145,780 | A | 11/2000 | Fontana | |
| 6,216,978 | B1 | 4/2001 | Rodriguez | |
| 6,601,743 | B2 * | 8/2003 | Godshaw | 224/153 |
| 6,966,791 | B1 | 11/2005 | Farr | |

(Continued)

OTHER PUBLICATIONS

Photograph of CommScope Hard Plastic Case, available as of Application Date.

(Continued)

*Primary Examiner* — William E Dondero

(74) *Attorney, Agent, or Firm* — Myers Bigel & Sibley, P.A.

(57) ABSTRACT

A communications cable payout bag includes: a main compartment configured to hold a communications cable package; a shoulder strap attached to the exterior of the bag; a pair of handle straps attached to the exterior of the bag, wherein each handle strap is shorter than the shoulder strap; a cable payout passageway between the main compartment and the exterior of the bag; and a closure mechanism configured to close the main compartment.

13 Claims, 7 Drawing Sheets

(56) References Cited

U.S. PATENT DOCUMENTS

| | | | | |
|---|---|---|---|---|
| D529,286 | S | 10/2006 | Limber | |
| 7,320,445 | B2 * | 1/2008 | Eastwood et al. | 242/598.4 |
| 7,792,316 | B2 | 9/2010 | Tan et al. | |
| 2002/0125161 | A1 * | 9/2002 | Cote | 206/408 |
| 2007/0215502 | A1 | 9/2007 | Babcock et al. | |
| 2009/0260922 | A1 | 10/2009 | Marquardt et al. | |
| 2010/0006692 | A1 | 1/2010 | Galgano et al. | |
| 2010/0314484 | A1 | 12/2010 | Houston et al. | |
| 2010/0320310 | A1 | 12/2010 | McManus et al. | |

OTHER PUBLICATIONS

Photograph of CommScope Cardboard Package, available as of Application Date.
Photograph of CommScope CablePak Jr., available as of Application Date.
Photographs of TFC Backpack (3 pgs), available as of Application Date.

* cited by examiner

COMMUNICATIONS CABLE PAYOUT BAGS

FIELD OF THE INVENTION

The present invention relates generally to bags and, more particularly, to bags for holding cable.

BACKGROUND

It is often necessary for technicians to carry a bulk amount of cable, such as coaxial cable, when performing installations, changes and repairs. Bulk amounts of cable are typically wound in coils (e.g., on reels or spools). Cable payout may be controlled by unwinding a desired amount of cable from the coil.

Cable coils are preferably portable to allow the technician to pay out cable at various locations. However, carrying a coil by hand may be undesirable due to the coil's size, weight and unwieldy nature. Furthermore, cable may become unorganized and/or tangled when paid out from an unrestrained coil.

SUMMARY

Communications cable payout bags as well as methods of paying out cable from a bag are provided. According to some embodiments, a communications cable payout bag includes: a main compartment configured to hold a communications cable package; a shoulder strap attached to the exterior of the bag; a pair of handle straps attached to the exterior of the bag, wherein each handle strap is shorter than the shoulder strap; a cable payout passageway between the main compartment and the exterior of the bag; and a closure mechanism configured to close the main compartment. In some embodiments, the bag also includes a cable package within the main compartment.

In other embodiments, a communications cable payout bag includes: a main compartment; a removable insert having an open top and an opening within the main compartment, the removable insert configured to hold a reel of communications cable; a shoulder strap attached to the exterior of the bag; a pair of handle straps attached to the exterior of the bag, wherein each handle strap is shorter than the shoulder strap; a cable payout passageway between the main compartment and the exterior of the bag that is aligned with the opening of the removable insert; and a closure mechanism that is configured to close the removable insert in the main compartment. In some particular embodiments, the bag also includes a reel of cable within the removable insert.

A method of paying out communications cable from a bag that includes a main compartment and a cable payout passageway includes: inserting a removable insert having an open top and an opening that is aligned with the cable payout passageway in the main compartment, inserting a reel of communications cable having a loose end of cable in the removable insert through the open top; aligning the loose end of cable with the opening of the removable insert and the cable payout passageway; and pulling the loose end of cable through the opening of the removable insert and the cable payout passageway.

DETAILED DESCRIPTION

Figure 1:
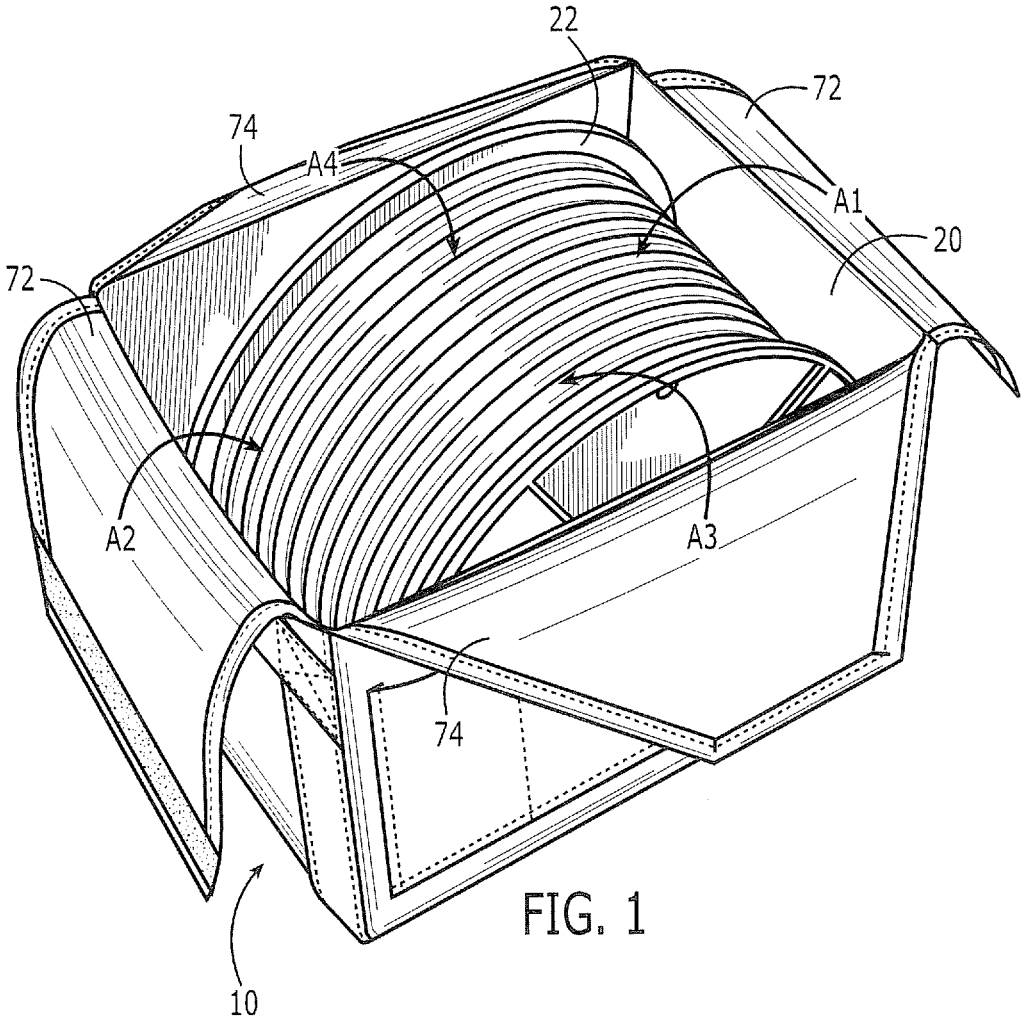
FIG. 1 is a front perspective view of a communications cable payout bag in an open configuration and a cable package according to some embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Well-known functions or constructions may not be described in detail for brevity and/or clarity.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a," "an" and "the" are intended to include the plural forms as well, unless the context clearly indicates otherwise. As used herein, the term "and/or" includes any and all combinations of one or more of the associated listed items. Where used, the terms "attached," "connected," "interconnected," "contacting," "coupled," "mounted," "overlying" and the like can mean either direct or indirect attachment or contact between elements, unless stated otherwise.

Referring now to the figures, a communications cable payout bag, designated broadly at 10, is illustrated in FIG. 1. The bag 10 is generally constructed of a flexible material such as canvas, a synthetic polymer (e.g., nylon) or any other flexible material. The flexible material may be selected to prevent damage to the bag 10 and/or its contents due to moisture and/or general handling.

The bag 10 includes a main compartment 20. The main compartment 20 is configured to hold cable that is to be paid out from the main compartment 20 to the exterior of the bag 10. More specifically, the main compartment 20 is configured to hold a cable package 22, such as a communications cable package. In some embodiments, the bag 10 includes the cable package 22 within the main compartment 20.

As illustrated in FIG. 1, the cable package 22 may be in the form of a coil, reel or spool of cable. The main compartment 20 of the bag 10 is configured to hold the coil, reel or spool of cable. Alternatively, the cable package 22 may comprise a box, such as a cardboard box, with cable contained therein. In this regard, the cable package 22 takes the shape of the box and the main compartment 20 of the bag 10 is configured to hold the box.

The bag 10 may take any shape. As illustrated in FIG. 1, the bag 10 may have a rectangular profile. This may allow a cable package 22 comprising a box having rectangular sides to be snugly held within the main compartment 20. The bag 10 having a rectangular profile may also hold a cable package 22 comprising a coil, reel or spool of cable, as exemplified in FIG. 1. Alternatively, the bag may have a circular profile, as described in more detail below. The size of the bag 10 may vary depending on the size of the cable package 22 to be held in the main compartment 20.

Figure 2:
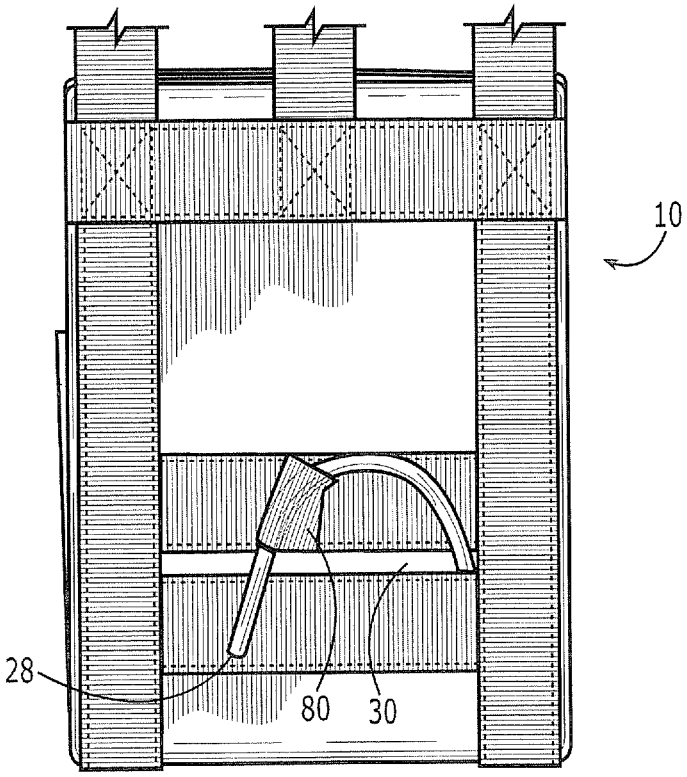
FIG. 2 is a side view of the communications cable payout bag of FIG. 1 in a closed configuration.

Turning now to FIG. 2, the bag 10 includes a cable payout passageway 30 between the main compartment 20 and the exterior of the bag 10. The cable payout passageway 30 serves to allow cable to be paid out from the main compartment 20 to the exterior of the bag 10. A loose end of cable 28 from the cable package 22 is aligned with the cable payout passageway 30 from inside the main compartment 20 and then routed through the cable payout passageway 30.

The cable payout passageway 30 may be any size, although it should be large enough to easily align the loose end of cable 28 with the cable payout passageway 30 and to prevent undue friction while cable is paid out. The cable payout passageway 30 may take any shape. In some embodiments, and as illustrated in FIG. 2, the cable payout passageway 30 is in the form of a horizontal slot located on a side surface of the bag 10. In other embodiments, the cable payout passageway 30 is generally circular in shape and surrounded by a grommet. The grommet may be metal to further reduce friction as cable is paid out.

Figure 3:
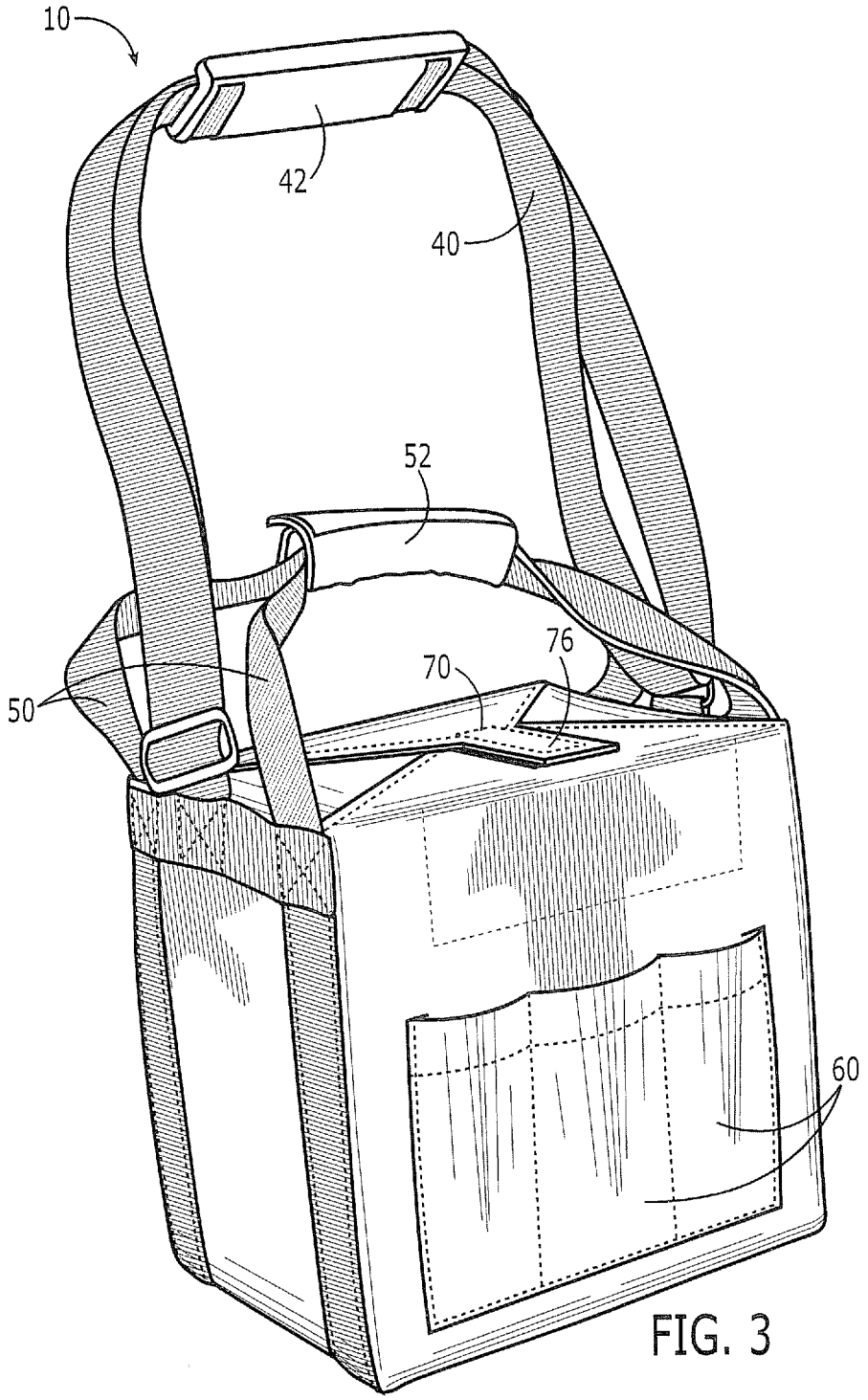
FIG. 3 is a front perspective view of the communications cable payout bag of FIG. 1 in a closed configuration.

Turning now to FIG. 3, the bag 10 includes a shoulder strap 40. As exemplified in FIG. 3, the shoulder strap 40 may include a padded portion 42 which may increase user comfort. The shoulder strap 40 may be adjustable in length such that the shoulder strap 40 may be adjusted to a length of at least 37 inches. The shoulder strap 40 may be adjustable in length such that the shoulder strap 40 may be adjusted to a length between about 37 and about 75 inches. In this regard, the shoulder strap 40 may be adjusted based on the user's size to allow the user to carry the bag 10 comfortably over his/her shoulder and neck or over his/her shoulder only. The shoulder strap 40 may be adjusted such that the cable package 22 is positioned near the user's hip. The shoulder strap 40 may serve to direct at least some of the weight of the cable package 22 to the user's hip region rather than sensitive back regions.

The shoulder strap 40 is attached to the exterior of the bag 10 in two locations. In some embodiments, the shoulder strap 40 is attached to first and second opposing surfaces of the exterior of the bag 10. In other embodiments, the shoulder strap 40 is attached to the top of the bag 10 in two locations. As exemplified in FIG. 3, the shoulder strap 40 may be attached to the center of the bag 10 such that the shoulder strap is centered over the cable package 22. Carrying the bag 10 by the shoulder strap 40 that is centered over the cable package 22 may result in substantially even weight distribution and increased stability.

The bag 10 also includes a pair of handle straps 50 to facilitate carrying the bag 10 by hand. The handle straps 50 are shorter in length than the shoulder strap 40. The handle straps may be unadjustable. The handle straps 50 are attached to the exterior of the bag 10. In some embodiments, the handle straps 50 are attached to first and second opposing surfaces of the exterior of the bag 10. In other embodiments, the handle straps 50 are attached to the top of the bag 10. The handle straps 50 are generally configured such that they can be centered over the cable package 22. Carrying the bag 10 by handle straps 50 that are centered over the cable package 22 may result in substantially even weight distribution and increased stability. As exemplified in FIG. 3, at least one of the pair of handle straps 50 may include a flap 52 to couple the pair of handle straps 50 and to help center the handle straps 50 over the cable package 22. The flap 52 may comprise a closure device, such as snaps, hook and loop fasteners (e.g., VELCRO®) or any closure device known to those of ordinary skill in the art, such that the handle straps 50 remain coupled. The flap 52 may be at least partially padded to increase user comfort.

In some embodiments, at least one storage pouch 60 may be attached to the exterior of the bag 10. The pouch(es) 60 may be configured to hold and provide easy access to items such as connector tools and prep tools, etc.

The bag 10 further includes a closure mechanism 70 configured to close the main compartment 20. In some embodiments, the closure mechanism 70 comprises flaps with fasteners, such as hook and loop fasteners. In other embodiments, the closure mechanism 70 comprises one or more zippers. Other exemplary closure mechanisms 70 include belts, buckles, buttons, clips, drawstrings, snaps or other closure mechanisms as understood by those of ordinary skill in the art. In some embodiments, the closure mechanism 70 is located at the top of the bag 10. In this regard, the cable package 22 may be inserted in the main compartment 20, and the top of the bag 10 may be closed via the closure mechanism 70 to enclose the main compartment 20 and the cable package 22 held therein. Locating the closure mechanism 70 at the top of the bag 10 may reduce the possibility of the cable package 22 falling out of the bag 10 while being carried by the shoulder strap 40 or handle straps 50.

In some embodiments, and as illustrated in FIGS. 1 and 3, the closure mechanism 70 comprises a first and second pair of opposing flaps 72, 74. The first pair of flaps 72 may be brought together as indicated by arrows A1, A2 and may be secured by hook and loop fasteners, for example. The second pair of flaps 74 may then be brought together as indicated by arrows A3, A4 and may also be secured by hook and loop fasteners, for example. One of the second pair of flaps 74 may include a tongue 76. The tongue 76 may serve to tension the bag to conform to the size of the cable package 22. The tongue 76 may further serve to easily open and/or close the bag 10.

Referring again to FIG. 2, the bag 10 may further include a cable lock 80 configured to secure the loose end of cable 28 on the exterior of the bag 10. In this regard, the loose end of cable 28 that has already passed through the cable payout passageway 30 may be staged or stored until more cable is to be paid out from the main compartment 20 of the bag 10. In some embodiments, and as illustrated in FIG. 2, the cable lock 80 comprises a loop that is sewn or otherwise attached to the exterior of the bag 10. In other embodiments, the cable lock 80 may be a clip or any other cable lock known to those of ordinary skill in the art. In still other embodiments, the cable lock 80 may be integrated with the shoulder strap 40 or the handle straps 50 where they are attached to the bag 10. The cable lock 80 will typically be located on the same side of the bag 10 as the cable payout passageway 30.

Figure 4:
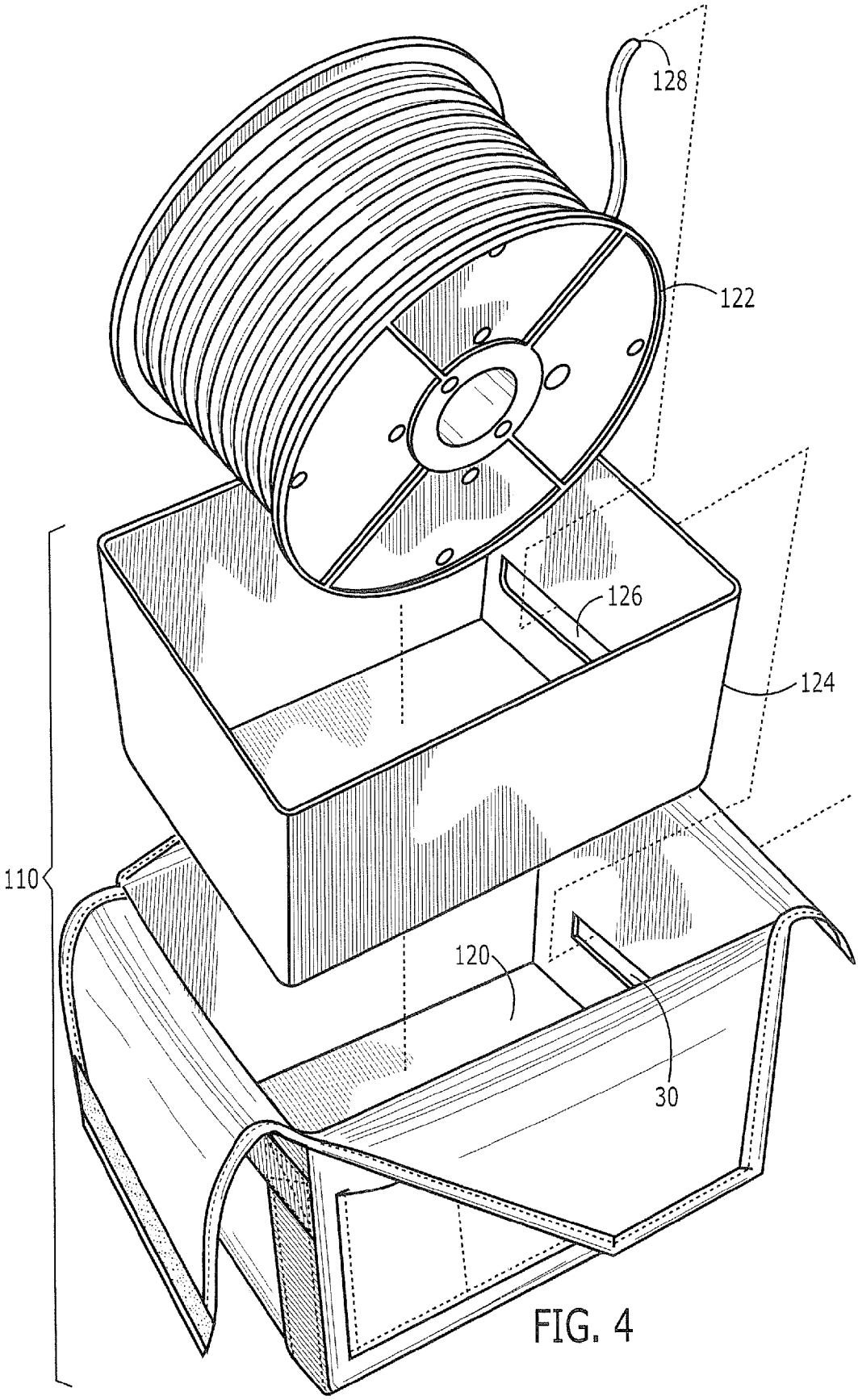
FIG. 4 is a front perspective view of a communications cable payout bag in an open configuration, a removable insert and a reel of cable according to some other embodiments of the present invention.

A communications cable payout bag, designated broadly at 110, is illustrated in FIG. 4. Unless otherwise specified, the bag 110 may have the same characteristics (e.g., shape, size, material) as the bag 10 described above.

The bag 110 has a main compartment 120. The bag 110 includes a removable insert 124 that fits within the main compartment 120, wherein the removable insert 124 is configured to hold a reel of cable 122, such as a reel of communications cable. The removable insert 124 has an open top which allows the reel of cable 122 to be inserted therein. In some embodiments, the bag 110 includes the reel of cable 122 within the removable insert 124.

The reel portion of the reel of cable 122 may be plastic, cardboard, metal or some other material. The removable insert 124 may be constructed of solid formed plastic, corrugated plastic or corrugated cardboard.

Use of the removable insert 124 and the reel of cable 122 may provide a more environmentally-friendly solution. The removable insert 124 generally has a lifetime greater than the reel of cable 122. Therefore, when the reel of cable 122 is empty (i.e., all the cable contained thereon has been paid out), the empty reel may be removed from the removable insert 124 and replaced with a new reel of cable. Less material may be consumed in that replacement reels of cable 122 may require less packaging (e.g., replacement reels of cable need not be contained in boxes). The empty reels may be recycled. The removable insert 124 may simply be removed and replaced when it becomes damaged or worn, at which time it may be recycled as well.

The bag 110 includes a cable payout passageway 30. The cable payout passageway 30 serves to allow cable to be paid out from the main compartment 120 to the exterior of the bag 110. In some embodiments, the cable payout passageway 30 is in the form of a horizontal slot located on a side of the bag 110.

The removable insert 124 also includes an opening 126 which is generally aligned with the cable payout passageway 30. The opening 126 may be located on a side surface of the removable insert 124. The opening 126 may be in the form of a horizontal slot where the cable payout passageway 30 is in the form of a horizontal slot. However, the cable payout passageway 30 may take any shape, as described in more detail above in connection with the bag 10. Accordingly, the opening 126 may take any shape, as well.

A loose end of cable 128 from the reel of cable 122 is aligned with the opening 126 and the cable payout passageway 30 from inside the removable insert 124 and then routed through the opening 126 and cable payout passageway 30.

The bag 110 includes a shoulder strap 40 (not shown in FIG. 4), a pair of handle straps 50 (not shown in FIG. 4) and a closure mechanism 70 (not shown in FIG. 4) configured to close the removable insert 124 in the main compartment 120, all as described above in connection with the bag 10 and as exemplified in FIG. 3. In some embodiments, the bag 110 includes a padded portion 42 (not shown in FIG. 4) associated with the shoulder strap 40 and/or a flap 52 (not shown in FIG. 4) associated with the pair of handle straps 50, as described above in connection with the bag 10 and as exemplified in FIG. 3. In some embodiments, at least one storage pouch 60 (not shown in FIG. 4) may be attached to the exterior of the bag 110 as described above in connection with the bag 10 and as exemplified in FIG. 3. In some embodiments, the bag 110 includes a cable lock 80 (not shown in FIG. 4) that is configured to secure the loose end of cable 128 on the exterior of the bag 110 as described above in connection with the bag 10 and as exemplified in FIG. 2.

A method of paying out cable from the bag 110 is now presented. The removable insert 124 is inserted in the main compartment 120 of the bag 110 such that the opening 126 is aligned with the cable payout passageway 30. The reel of cable 122 having the loose end of cable 128 is inserted in the removable insert 124 through the open top. The loose end of cable 128 is aligned with the opening 126 and the cable payout passageway 30. The loose end of cable 128 is pulled a desired distance through the opening 126 and the cable payout passageway 30.

The method may further comprise a step of enclosing the removable insert 124 and the reel of cable 122 in the main compartment 120 by the closure mechanism 70, as described in more detail above.

Figure 5:
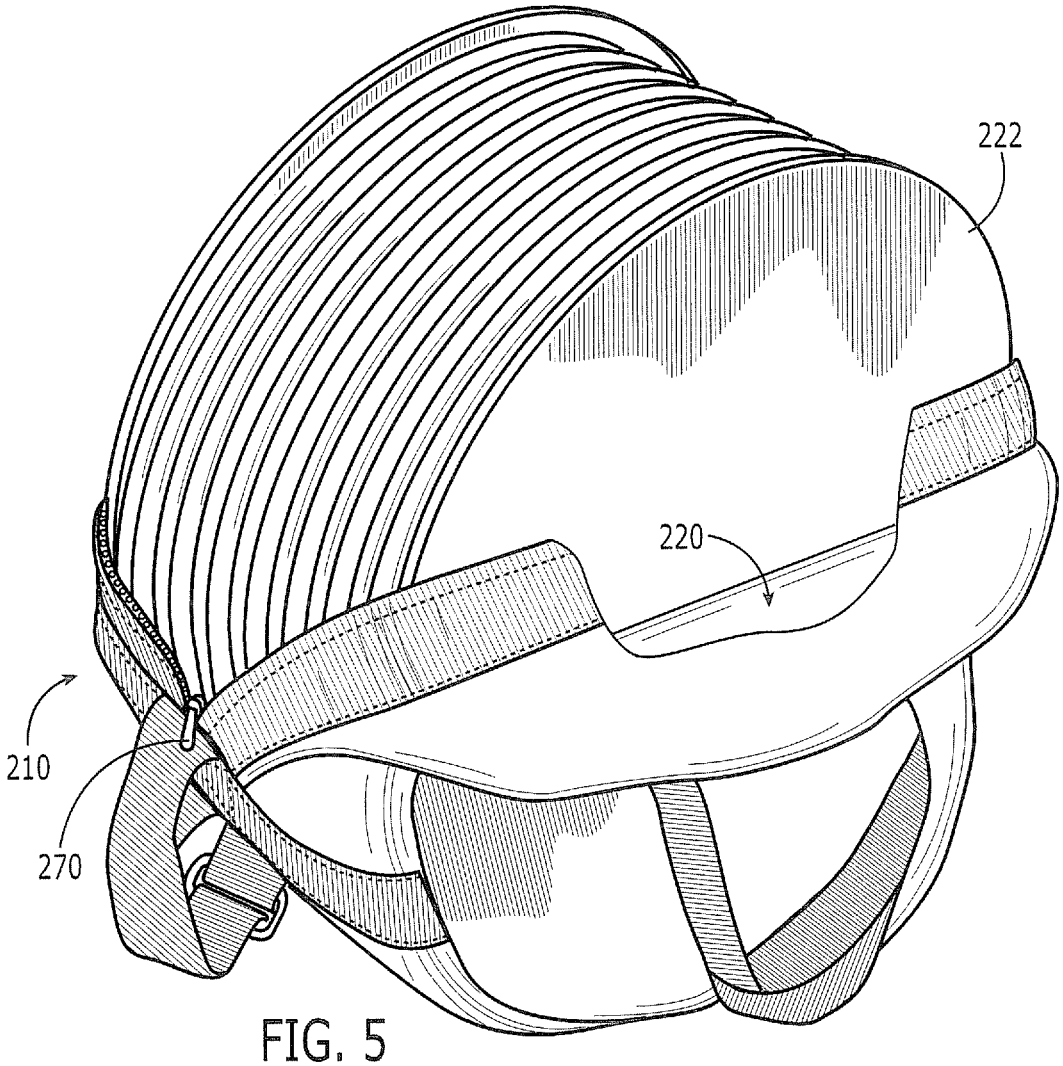
FIG. 5 is a front perspective view of a communications cable payout bag in an open configuration and a cable package according to further embodiments of the present invention.

A communications cable payout bag, designated broadly at 210, is illustrated in FIG. 5. The bag 210 includes a main compartment 220, as exemplified in FIG. 5 at the cut-away portion of the bag 210. The main compartment 220 is configured to hold cable that is to be paid out from the main compartment 220 to the exterior of the bag 210. More specifically, the main compartment 220 is configured to hold a cable package 222 in the form of a coil, reel or spool of cable (e.g., communications cable). In some embodiments, the bag 210 includes the cable package 222 within the main compartment 220.

The bag 210 has a generally circular profile. In this regard, the bag 210 may be configured to snugly hold the cable package 222 in the form of a coil, reel or spool cable. The bag 210 may be sized to snugly hold standard coils, reel or spools of cable.

Figure 6:
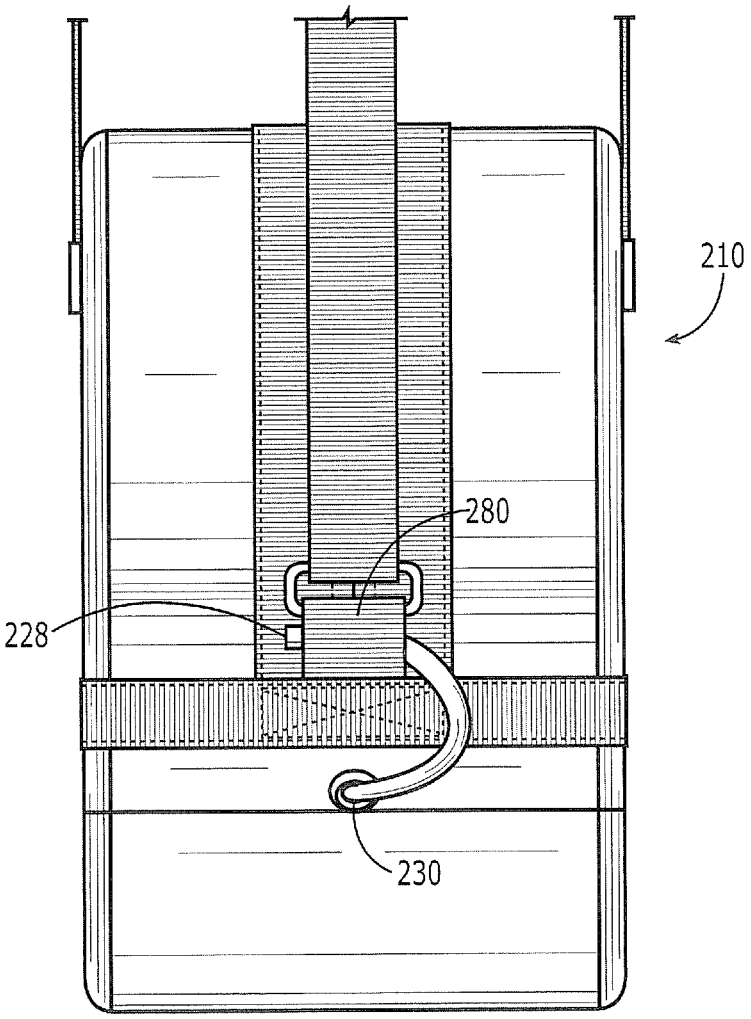
FIG. 6 is a side view of the communications cable payout bag of FIG. 5 in a closed configuration.

Turning now to FIG. 6, the bag 210 includes a cable payout passageway 230 between the main compartment 220 and the exterior of the bag 210. The cable payout passageway 230 serves to allow cable to be paid out from the main compartment 220 to the exterior of the bag 210. A loose end of cable 228 from the cable package 222 is aligned with the cable payout passageway 230 from inside the main compartment 220 and then routed through the cable payout passageway 230.

The cable payout passageway 230 may be any size, although it should be large enough to easily align the loose end of cable 228 with the cable payout passageway 230 and to prevent undue friction while cable is paid out. The cable payout passageway 230 may take any shape. In some embodiments, and as illustrated in FIG. 6, the cable payout passageway 230 is generally circular in shape and surrounded by a grommet. The grommet may be metal to further reduce friction as cable is paid out. The cable payout passageway 230 may take any other shape, such as a horizontal slot located on a side surface of the bag 210.

Figure 7:
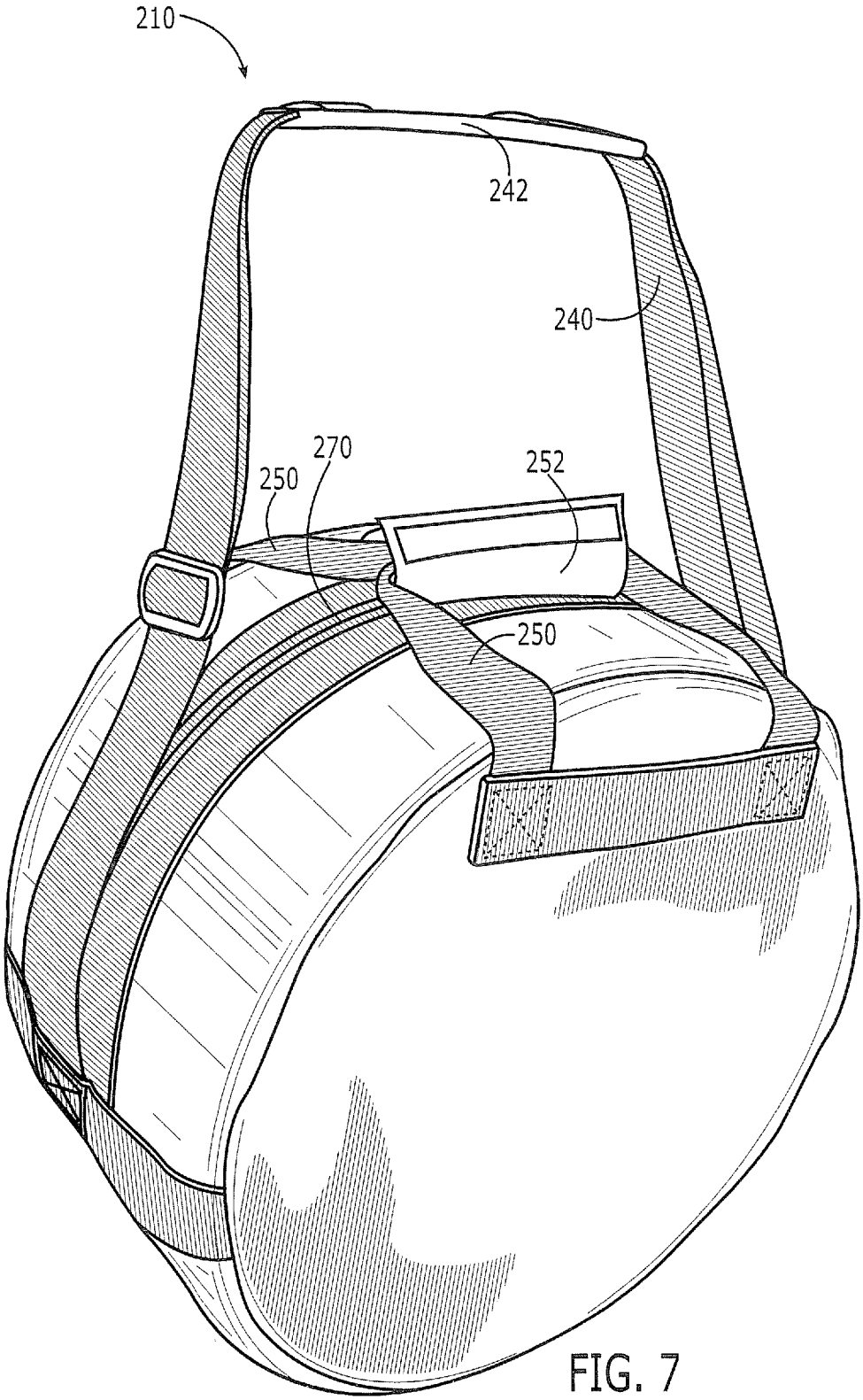
FIG. 7 is a front perspective view of the communications cable payout bag of FIG. 5 in a closed configuration.

Turning now to FIG. 7, the bag 210 includes a shoulder strap 240. As exemplified in FIG. 6, the shoulder strap 240 may include a padded portion 242 which may increase user comfort. The shoulder strap 240 may be adjustable in length such that the shoulder strap 240 may be adjusted to a length of at least 39 inches. The shoulder strap 240 may be adjustable in length such that the shoulder strap 240 may be adjusted to a length between about 39 and about 74 inches. In this regard, the shoulder strap 240 may be adjusted based on the user's size to allow the user to carry the bag 210 comfortably over his/her shoulder and neck or over his/her shoulder only. The shoulder strap 240 may be adjusted such that the cable package 222 is positioned near the user's hip. The shoulder strap 240 may serve to direct at least some of the weight of the cable package 222 to the user's hip region rather than sensitive back regions.

The shoulder strap 240 is attached to the exterior of the bag 210 in two locations. In some embodiments, the shoulder strap 240 is attached to first and second opposing surfaces of the exterior of the bag 210. In other embodiments, the shoulder strap 240 is attached to the top of the bag 210 in two locations. As exemplified in FIG. 7, the shoulder strap 240 may be attached to the center of the bag 210 such that the shoulder strap is centered over the cable package 222. Carrying the bag 210 by the shoulder strap 240 that is centered over the cable package 222 may result in substantially even weight distribution and increased stability.

The bag 210 also includes a pair of handle straps 250 to facilitate carrying the bag 210 by hand. The handle straps 250 are shorter in length than the shoulder strap 240. The handle straps 250 are attached to the exterior of the bag 210. In some embodiments, the handle straps 250 are attached to first and second opposing surfaces of the exterior of the bag 210. In other embodiments, the handle straps 250 are attached to the top of the bag 210. The handle straps 250 are generally configured such that they can be centered over the cable package 222. Carrying the bag 210 by handle straps 250 that are centered over the cable package 222 may result in substantially even weight distribution and increased stability. As exemplified in FIG. 7, at least one of the pair of handle straps 250 may include a flap 252 to couple the pair of handle straps 250 and to help center the handle straps 250 over the cable package 222. The flap 252 may comprise a closure device, such as snaps, hook and loop fasteners (e.g., VELCRO®) or any closure device known to those of ordinary skill in the art, such that the handle straps 250 remain coupled. The flap 252 may be at least partially padded to increase user comfort.

In some embodiments, at least one storage pouch 260 (not shown) may be attached to the exterior of the bag 210. The pouch(es) 260 may be configured to hold and provide easy access to items such as connector tools and prep tools, etc.

The bag 210 further includes a closure mechanism 270 configured to close the main compartment 220. In some embodiments, and as exemplified in FIGS. 5 and 7, the closure mechanism 270 comprises one or more zippers. In other embodiments, the closure mechanism 270 comprises flaps with fasteners, such as hook and loop fasteners. Other exemplary closure mechanisms 270 include belts, buckles, buttons, clips, drawstrings, snaps or other closure mechanisms as understood by those of ordinary skill in the art. In some embodiments, the closure mechanism 270 is located at the top of the bag 210. In this regard, the cable package 222 may be inserted in the main compartment 220, and the top of the bag 210 may be closed via the closure mechanism 270 to enclose the main compartment 220 and the cable package 222 held therein. Locating the closure mechanism 270 at the top of the bag 210 may reduce the possibility of the cable package 222 falling out of the bag 210 while being carried by the shoulder strap 240 or handle straps 250.

Referring again to FIG. 6, the bag 210 may further include a cable lock 280 configured to secure the loose end of cable 228 on the exterior of the bag 210. In this regard, the loose end of cable 228 that has already passed through the cable payout passageway 230 may be staged or stored until more cable is to be paid out from the main compartment 220 of the bag 210. In some embodiments, and as illustrated in FIG. 6, the cable lock 280 comprises a loop that is sewn or otherwise attached to the exterior of the bag 210. In other embodiments, the cable lock 280 may be a clip or any other cable lock known to those of ordinary skill in the art. In still other embodiments, the cable lock 280 may be integrated with the shoulder strap 240 or the handle straps 250 where they are attached to the bag 210. The cable lock 280 will typically be located on the same side of the bag 210 as the cable payout passageway 230.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications cable payout bag, comprising:

a main compartment constructed of a flexible material, the main compartment having an interior and an exterior, the main compartment being openable and closable;

a shoulder strap attached to the exterior of the main compartment;

a pair of handle straps attached to the exterior of the main compartment, wherein each handle strap is shorter than the shoulder strap;

a reel of communications cable within the interior of the main compartment, the reel of communications cable having a loose end of cable at an outer portion thereof;

a cable payout passageway defined between the interior and the exterior of the main compartment, the cable payout passageway configured to receive therethrough the loose end of cable from the outer portion of the reel of communications cable; and a closure mechanism configured to close the main compartment.

2. The communications cable payout bag of claim 1, wherein the cable payout passageway comprises an elongated slot located on a side surface of the main compartment.

3. The communications cable payout bag of claim 1, wherein at least one of the pair of handle straps includes a flap configured to couple the handle straps.

4. The communications cable payout bag of claim 1, further comprising a cable lock configured to secure the loose end of cable on the exterior of the main compartment.

5. The communications cable payout bag of claim 4, wherein the cable lock is located on the exterior of the main compartment adjacent the cable payout passageway.

6. The communications cable payout bag of claim 1, further comprising at least one storage pouch on the exterior of the main compartment.

7. The communications cable payout bag of claim 1, wherein the closure mechanism comprises a pair of connectable flaps.

8. The communications cable payout bag of claim 7, wherein one of the flaps includes an outwardly extending tongue.

9. A method of paying out communications cable from a bag that includes a main compartment and a cable payout passageway, the method comprising:

inserting a removable plastic insert and a cylindrical reel of communications cable supported by the removable insert in the main compartment, wherein the reel of communications cable has a loose end of cable at an outer portion thereof, and wherein the main compartment is constructed of a flexible material;

aligning the loose end of cable from the outer portion of the reel of communications cable with the cable payout passageway; and pulling the loose end of cable through the cable payout passageway.

10. A communications cable payout bag, comprising:

a main compartment constructed of a flexible material, the main compartment having an interior and an exterior, the main compartment being openable and closable;

a removable insert within the interior of the main compartment;

a reel of communications cable that is supported by the removable insert, the reel of communications cable having a loose end of cable at an outer portion thereof;

a shoulder strap attached to the exterior of the main compartment;

a cable payout passageway defined between the interior and the exterior of the main compartment, the cable payout passageway configured to receive therethrough the loose end of cable from the outer portion of the reel of communications cable; and a closure mechanism configured to close the main compartment to thereby close the removable insert and the reel of communications cable in the interior of the main compartment;

wherein the main compartment has a substantially rectangular profile when the removable insert and the reel of communications cable are closed in the interior thereof.

11. The communications cable payout bag of claim 10, wherein the shoulder strap comprises a single adjustable shoulder strap, and wherein the shoulder strap can be adjusted to a length of at least 37 inches.

12. The communications cable payout bag of claim 10, further comprising at least one storage pouch on the exterior of the main compartment.

13. The communications cable payout bag of claim 10, further comprising a cable lock configured to secure the loose end of cable on the exterior of the main compartment, wherein the cable lock is located on the exterior of the main compartment adjacent the cable payout passageway.

* * * * *